US006752066B2

(12) United States Patent
Varetto et al.

(10) Patent No.: US 6,752,066 B2
(45) Date of Patent: Jun. 22, 2004

(54) DEVICE FOR CONTROLLING THE OSCILLATION OF THE ARM OF A HANDLING EQUIPMENT OF THE SWINGABLE LEVER TYPE

(75) Inventors: Ener Varetto, Sant'Ambrogio (IT); Lio Piccolo, Grugliasco (IT)

(73) Assignee: VEP Automation S.R.L., Beinasco (IT)

( * ) Notice: Subject to any disclaimer, the term of this patent is extended or adjusted under 35 U.S.C. 154(b) by 64 days.

(21) Appl. No.: 10/252,550

(22) Filed: Sep. 24, 2002

(65) Prior Publication Data

US 2003/0089225 A1 May 15, 2003

(30) Foreign Application Priority Data

Sep. 25, 2001 (IT) ..... TO2001A0915

(51) Int. Cl.[7] ..... F15B 15/22
(52) U.S. Cl. ..... 92/17; 92/18; 92/20; 92/21 R
(58) Field of Search ..... 92/17, 18, 20, 92/21 R, 21 MR, 22, 23, 28, 82, 85 R, 136

(56) References Cited

U.S. PATENT DOCUMENTS 2,632,426 A * 3/1953 Geesink-De Graaf et al. .. 92/17
2,804,054 A * 8/1957 Geyer ..... 92/17
4,463,661 A * 8/1984 Tootle ..... 92/17
4,481,864 A * 11/1984 Peruzzi ..... 92/17
5,020,418 A * 6/1991 Sendoykas ..... 92/17
6,575,678 B2 * 6/2003 Cottrell ..... 92/17

* cited by examiner

*Primary Examiner*—Thomas E. Lazo
(74) *Attorney, Agent, or Firm*—Sughrue Mion, PPLC

(57) ABSTRACT

A handling equipment of the swingable arm type comprises a double acting cylinder within whose chamber a main piston is sealingly mounted, which is slidable owing to the selective delivery of fluid under pressure at opposite zones of the chamber, which is connected to a rod associated to the arm with a toggle joint. The equipment comprises a device for controlling the oscillation of the arm, including: a cavity of the rod having a nut screw, a screw member with a threaded shank in engagement with the nut screw, a rotatable head opposite to the rod and not slidably mounted with respect to the cylinder, and means for controlling the rotation of the screw member, associated with its head in order to brake the rotation of the screw member following to an anomalous condition in the feeding of fluid under pressure to the chamber of the cylinder.

19 Claims, 8 Drawing Sheets

Fig. 8
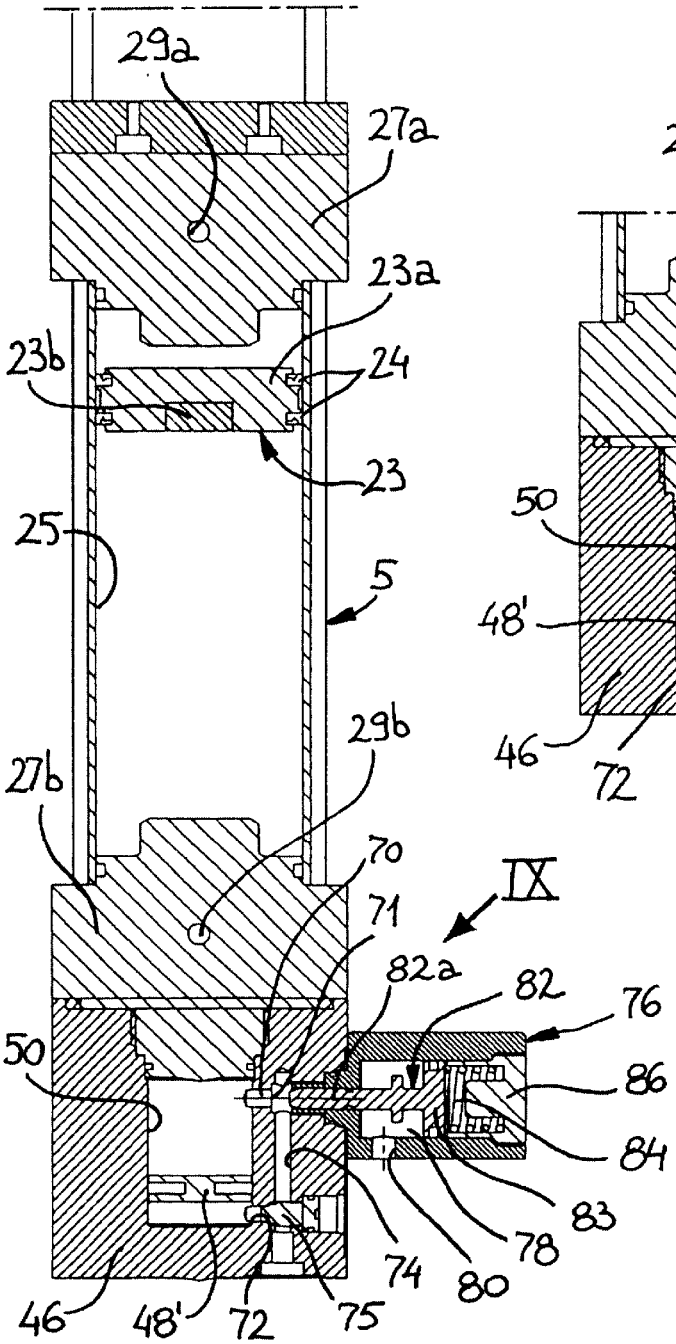
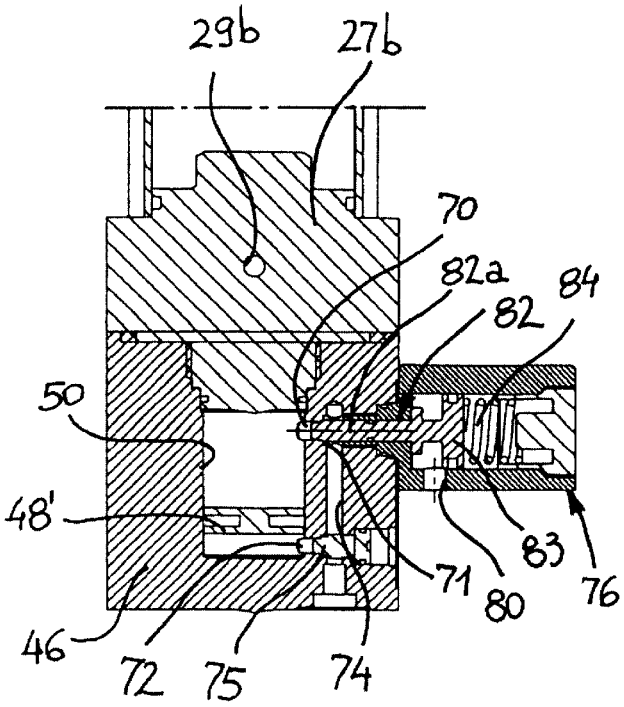
Fig. 9

DEVICE FOR CONTROLLING THE OSCILLATION OF THE ARM OF A HANDLING EQUIPMENT OF THE SWINGABLE LEVER TYPE

BACKGROUND OF THE INVENTION

The present invention refers in general to handling equipments of the so-called swingable lever type.

More particularly the invention relates to a device for controlling the oscillation of the arm of such an equipment comprising a driving double acting cylinder having a chamber in which a main piston is sealingly mounted, which is slidable as a result of the selective delivery of fluid under pressure at opposite zones of the chamber of the cylinder, the main piston being connected to a rod having a driving end which projects from the cylinder and is connected to said arm by a toggle joint.

In the equipments of the type defined above, for example in pneumatic handling equipments also known as tilter devices, anomalous conditions can take place during delivery of fluid under pressure to the chamber of the cylinder, which may involve risks for the integrity of the equipments themselves and for the apparatuses which are associated to them, or for possible operators which may be close to such equipments.

These anomalous conditions are essentially of two types.

A first anomalous condition can take place in the case in which, for example after a maintenance operation carried out on the equipment, the feeding and the exhaust lines of the fluid under pressure are not correctly connected to the opposite ends of the cylinder, in particular if an end of the cylinder is connected to the feeding of the fluid under pressure while the other end freely communicates with the outside environment. When, in such conditions, the fluid under pressure is only fed to one of the cylinder ends, the piston is moved violently against the cylinder end in communication with the outside environment, causing the arm of the equipment to fall down suddenly to an end-of-travel position.

Another anomalous condition occurs in the case of a pressure drop in the line for feeding the fluid under pressure to the cylinder, in particular if the oscillation axis of the arm of the equipment is not arranged vertically and if the piston has not reached as yet the end-of-stroke position in which the toggle joint makes its movement irreversible. In this case in fact, owing to the lack of pressure and under the weight of the apparatuses associated with the arm, it can fall down violently towards its lower end-of-travel position.

In order to overcome the aforesaid anomalous condition, devices for controlling the motion of the piston rod have been proposed which operate on the basis of the principle to apply a friction force against the outside surface of the rod in the case of a pressure drop. For this purpose, for example, brake devices may be used which include planes inclined with respect to the cylinder axis, to which rollers or balls are associated which are intended to interfere with the peripheral surface of the rod when a pressure drop below a predetermined threshold occurs. Other braking devices employ a laminar element having a through circular hole in which the rod is inserted, whose diameter is little greater than that of the rod. In the latter devices, in the operation with the fluid fed under normal pressure, the sheet element is perpendicular to the axis of the rod, whereby the rod can slide axially through it. In the case of pressure drop, the sheet element is placed in a configuration inclined with respect to the rod axis, in order to cause interference between the edges of its through hole and the radial surface of the rod, which causes the axial locking of the latter.

At any rate, the devices mentioned above for controlling the movement of the rod, and therefore the oscillation of the arm, may turn out to be not very practical or not very reliable in use. In fact, their operation can be affected by the dimensions of the mechanical members involved in the operation, so that the wear of one of the members of the device can jeopardize its good operation, such as the presence of foreign bodies, also if they are very small, in the fluid fed to the cylinder.

Moreover, such devices allow to lock the rod when it is moving along only one of its shifting directions and require therefore to be doubled in order to lock the motion of the rod in both its shifting directions. In practice, if inclined planes with rollers or balls are used, it will be necessary to provide inclined planes with respective rollers or balls for each shifting direction of the rod, while if pierced laminar elements are used for locking the rod, two laminar elements, one for each shifting direction of the rod will have to be provided.

In both the anomalous feeding conditions of the cylinder considered above, the traditional swingable lever handling equipments risk to endure serious damages which could jeopardize their operation and that of the apparatuses carried by their swingable arm, as well as to cause damages to possible people standing in proximity of the equipments, if they are not equipped with devices adapted to prevent the arm to fall down in the event of an anomaly in the feeding of fluid under pressure to the cylinder.

SUMMARY OF THE INVENTION

The main object of the present invention is therefore to provide a handling equipment of the swingable lever type, whose structure is fitted with a device for controlling the oscillation of the arm, said device being able to prevent that malfunctions may take place as a consequence of the anomalous conditions of feeding mentioned above.

This object is attained thanks to the fact that the device comprises:

- an axial cavity formed in the rod, in which a nut screw is arranged,
- a screw member comprising a threaded shank so arranged as to engage the nut screw of the rod, and a head portion opposite to the rod and mounted rotatably but not axially slidable with respect to the cylinder, and
- control means for controlling the rotating movement of the screw member, which are associated to the head portion of the screw member and are adapted to perform a braking action of its rotation when an anomalous condition occurs in the feeding of the fluid under pressure to the cylinder chamber.

BRIEF DESCRIPTION OF THE DRAWINGS

Further characteristics and advantages of the invention will become more clearly evident from the reading of the detailed description which follows, given purely by way of a non limiting example and referred to the attached drawings, in which:

FIG. 8 is an elevational view sectioned along the line VIII—VIII of FIG. 7, which also shows an interception valve device associated to the control device, FIG. 9 is a view of a detail indicated by the arrow IX in FIG. 8, in a working condition different from that illustrated in FIG. 8, and FIGS. 10 and 11 are views showing a modification of the interception valve device associated to the control device, in two operating conditions respectively corresponding to those shown in FIGS. 8 and 9.

DETAILED DESCRIPTION OF THE INVENTION

Figure 1:
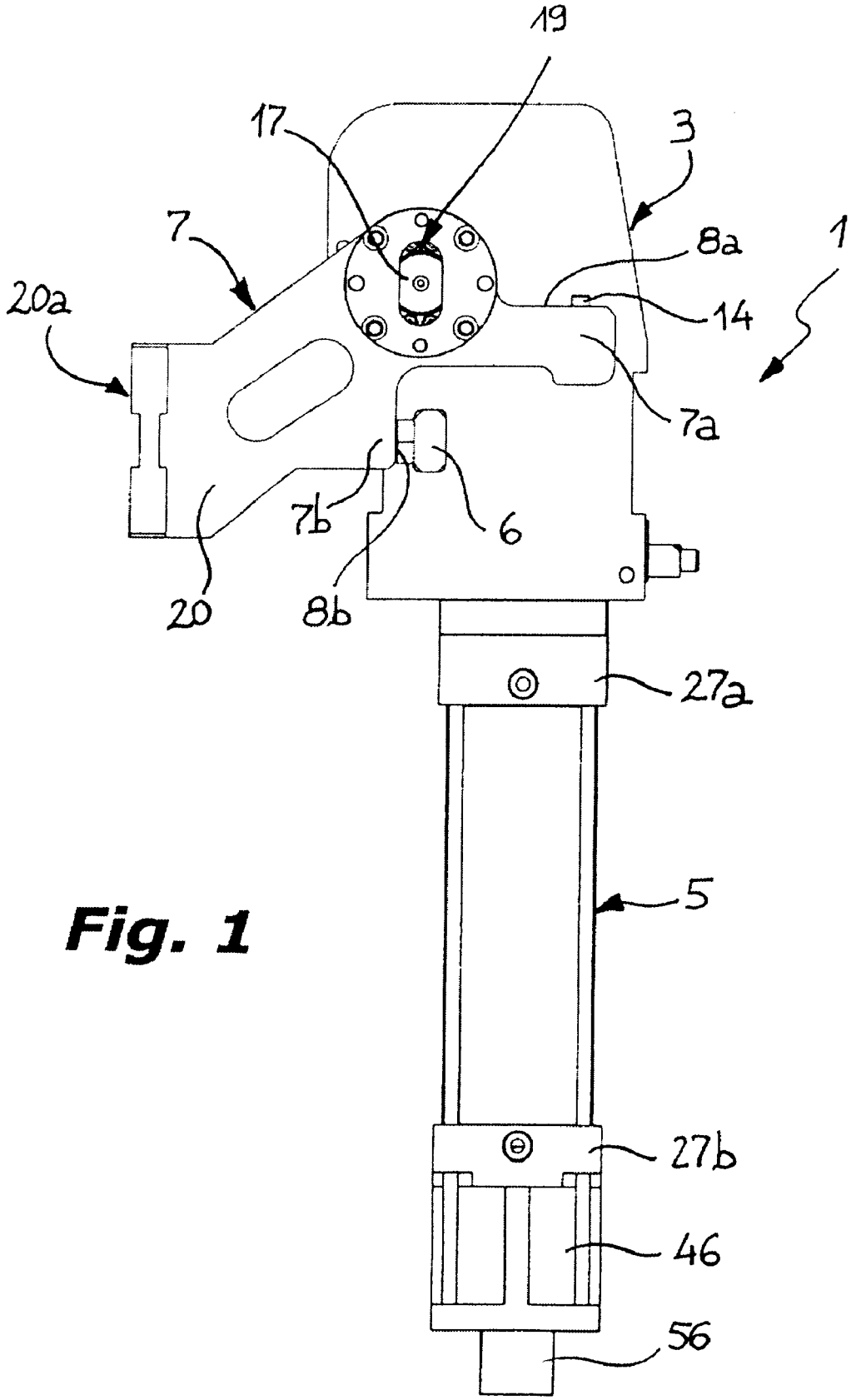
FIG. 1 is an elevational side view of a first embodiment of a swingable lever handling equipment provided with a control device according to the invention.
Figure 2:
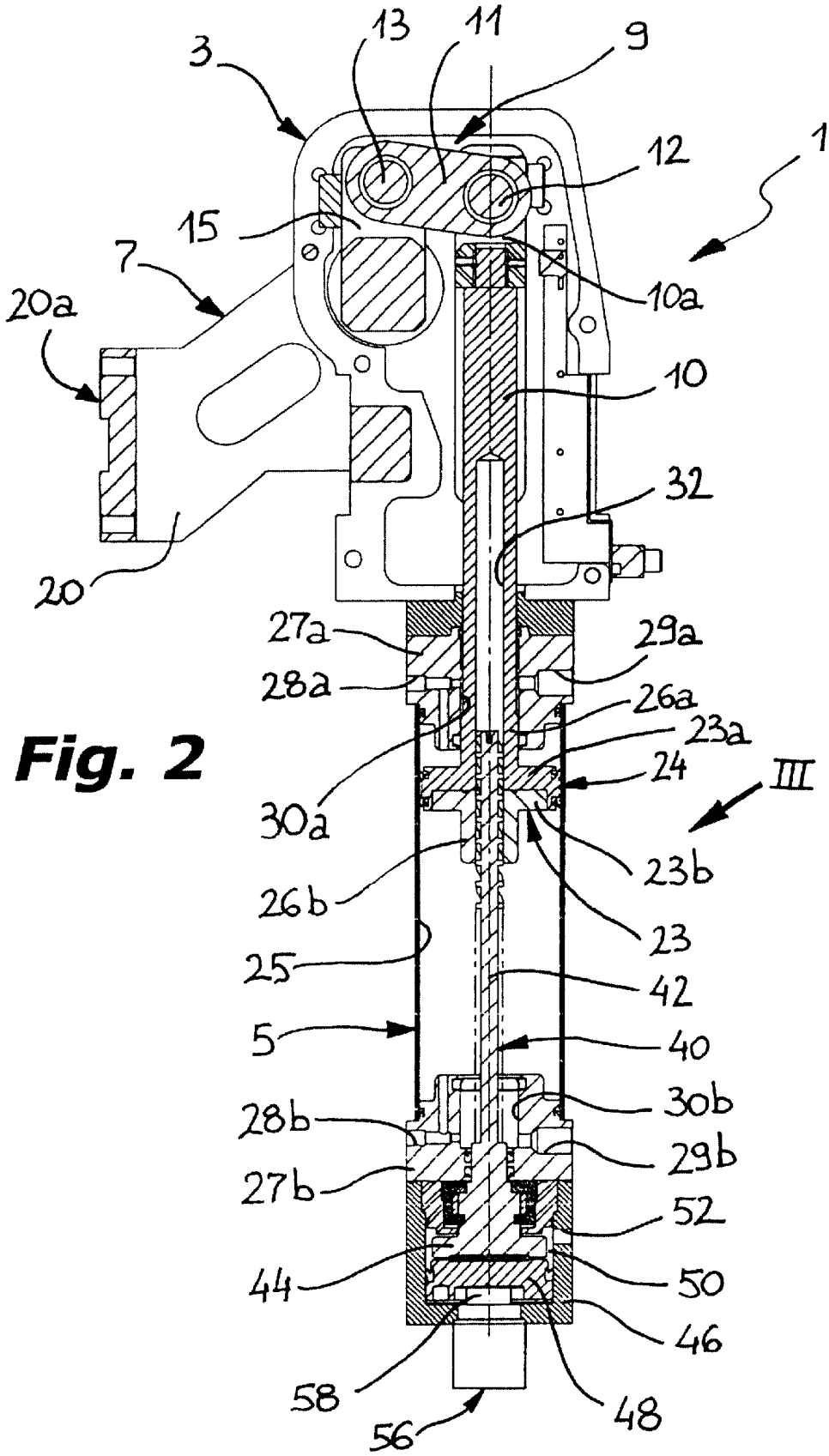
FIG. 2 is a view similar to that of FIG. 1, in cross-section.
Figure 3:
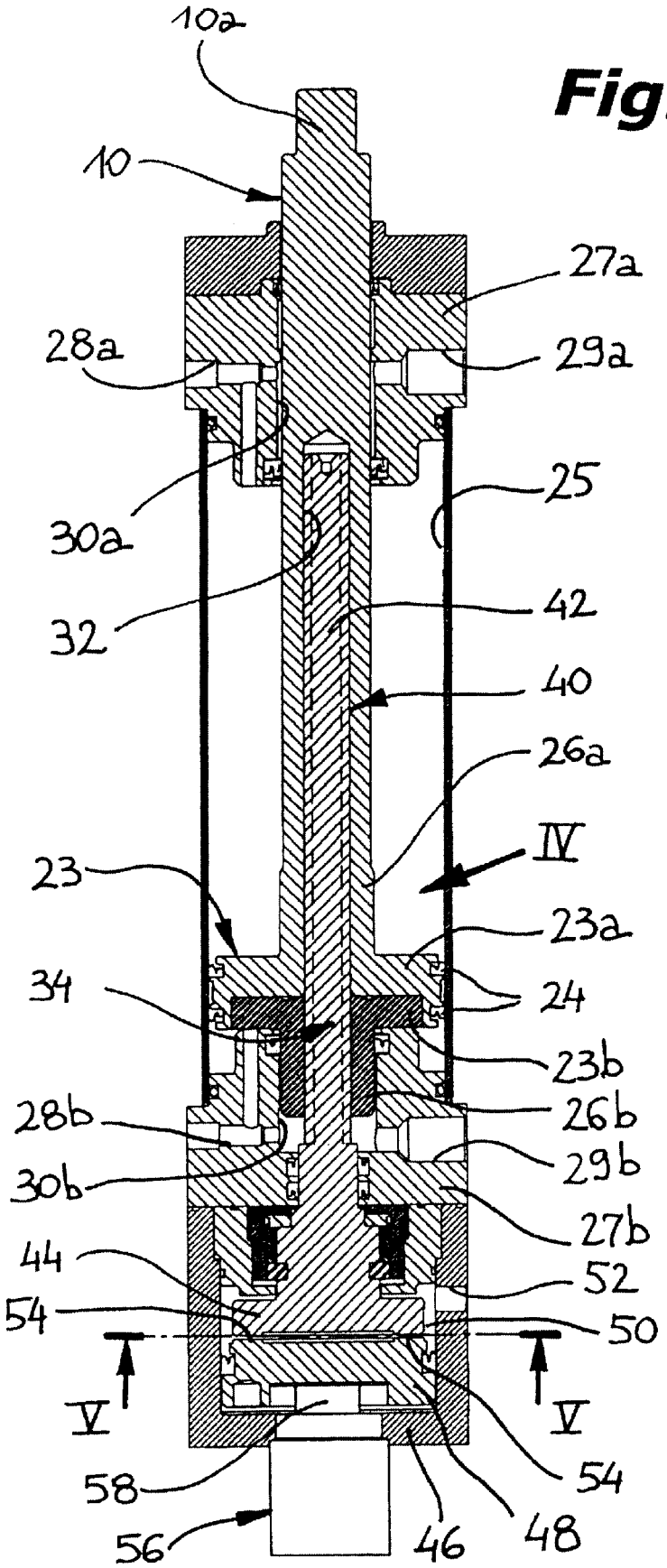
FIG. 3 is an enlarged view of a detail indicated by the arrow III in FIG. 2.
Figure 4:
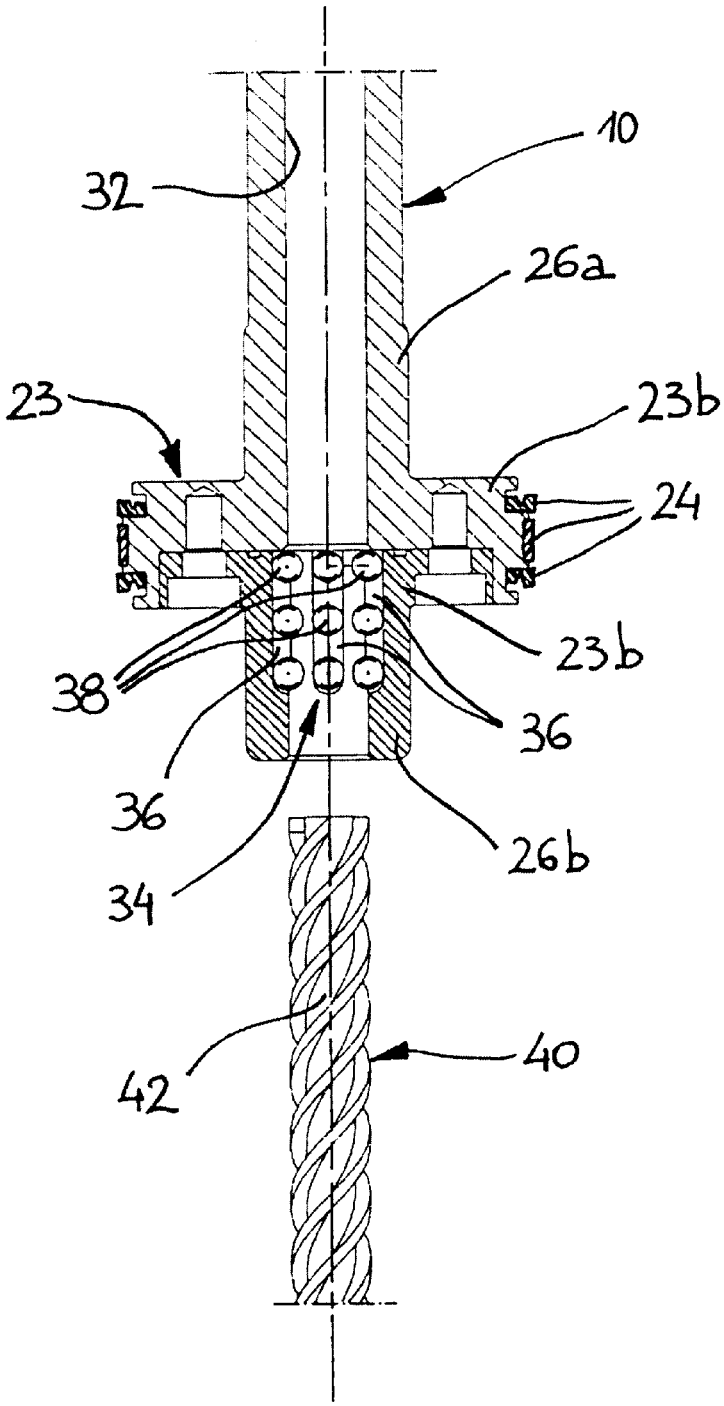
FIG. 4 is a partial, enlarged and exploded view of a detail indicated by the arrow IV in FIG. 3.
Figure 6:
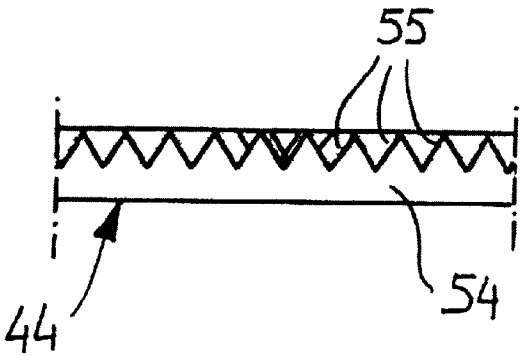
FIG. 6 is a schematic view of a portion of the element shown in FIG. 5, from the arrow VI.
Figure 5:
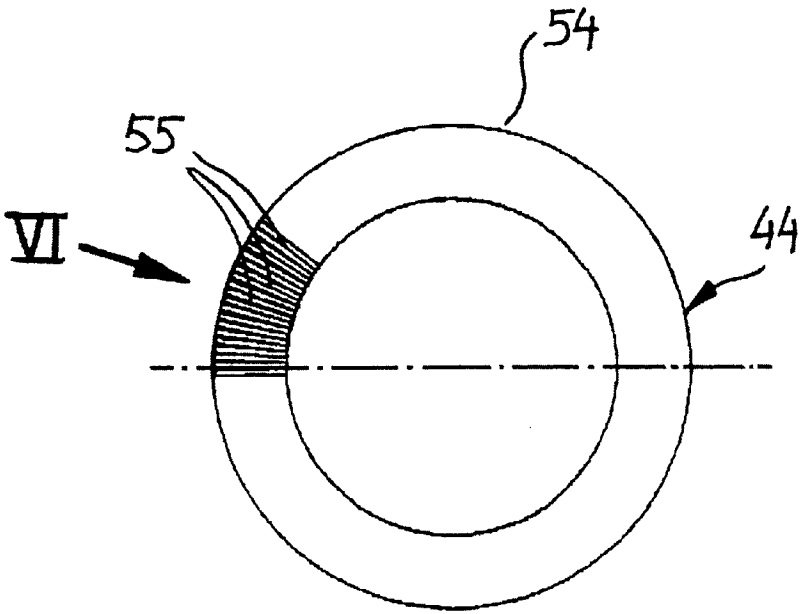
FIG. 5 is a schematic, partial front elevational view of an element of FIG. 3, taken along its line V—V.

With initial reference to FIGS. 1 to 6, 1 indicates as a whole a handling equipment of the swingable lever type, which is operated by means of fluid under pressure, typically air.

The equipment 1 comprises a body 3 to which a double acting fluid cylinder 5 is associated for driving a fork lever arm 7 by means of a toggle joint unit 9. The joint 9 comprises, in a manner known per se, a link member 11 an end of which rotatably engages a pin 13 of a crank 15, while the opposite end rotatably engages a hinge 12 associated to a driving end 10*a* of a rod 10. The crank 15 also comprises a pair of coaxial pins 17 spaced from the crank pin 13, projecting outside the body 3. Branches 20 of the arm 7 are connected to the pins 17 by keying devices 19 which are known per se. An attachment plate 20*a* having holes and/or openings in order to allow connection of apparatuses (not shown in the figures) to be moved by the equipment 1, is also fixed to the branches 20.

Each branch 20 of the arm 7 has a pair of protruding portions 7*a* and 7*b* on each of which a respective abutment surface 8*a*, 8*b* is formed. Such surfaces are intended to abut against a pair of projections 6 extending sideways with respect to the body 3, or to reach a position close to them, when one of the end oscillation positions of the arm 7 is attained. The surfaces 8*a* and 8*b* are angularly spaced from each other of 90°, in such a way that the arm 7 can be mounted according to two configurations angled of 90° to each other, in order that the equipment 1 can be easily adapted to any possible use requirement. One of the two possible mounting conditions of the arm 7 is shown in FIG. 1, in which, at one of its end-of-travel angular positions, the surfaces 8*b* of the two branches 20 abut on the projections 30 or reach a position close to them. In the other possible mounting condition not shown, at the corresponding end-of-travel position, the surfaces 8*a* of the two branches 20 abut on the projections 30 or reach a position close to them.

A main piston 23 which is connected to the rod 10, is slidably and sealingly mounted by annular seals 24, inside a chamber 25 defined by the body of the cylinder 5. The piston 23 is conveniently formed by two parts 23*a* and 23*b* connected to each other, for example by screw or other connecting members known per se, one of the two parts being formed integrally with the rod 10. Each of the parts 23*a*, 23*b* has a sleeve portion 26*a*, 26*b* having a diameter slightly larger than that of the rod 10.

The chamber 25 is axially defined by a pair of heads 27*a* and 27*b*, respectively arranged at its end adjacent to the body 3 and at the opposite end. Respective feeding and exhaust lines 28*a*, 28*b* and 29*a*, 29*b* for the fluid under pressure are formed in the heads 27*a* and 27*b*. The lines 28*a* and 28*b* or 29*a* and 29*b* are selectively connected, by a switching device of a type known per se, with a source of fluid under pressure, in order to produce alternatively over-pressure conditions on one of the faces of the piston 23, so as to cause the reciprocating motion of the piston 23 inside the chamber 25 between the heads 27*a* and 27*b*. Each of the lines 28*a*, 28*b* has preferably a pair of branch lines one of which ends in the chamber 25 facing a respective face of piston 23, the other one ending into a seat 30*a*, 30*b* for receiving a respective sleeve portion 26*a*, 26*b* of the piston 23 when the piston is in an end-of-stroke position.

An axial cavity 32 is formed inside the rod 10 and passes through the parts 23*a*, 23*b* of the piston 23 and through their sleeve portions 26*a*, 26*b*. A nut screw 34 is formed in the cavity 32 for the purposes that will be explained in the following. The nut screw 34 is preferably made by forming a plurality of axial grooves 36 with a semicircular bottom in the part 23*b* of the piston, for example four, and by placing in each of them an array of balls 38, for example three balls in each groove 36.

A screw member 40 is associated to the head 27*b* in order to pass through it, at the opposite side of the body 3 with respect to the cylinder 5. The screw member 40 has a threaded shank 42 which is coaxial with the cavity 32 so that its thread engages the nut screw 34. Conveniently, the grooves 36 of the nut screw 34 are axially open at the surface of separation between the part 23*b* and the part 23*a*, so as to allow to introduce the balls 38 in the grooves 36 while the shank 42 is inserted in the cavity 32 of the part 23*b*.

The thread of the shank 42 is preferably a multi-start screw thread, for example a four-start thread, each start of which has a pitch which is large with respect to the diameter of the shank 42 so that the shank 42 can easily rotate about its own axis as a result of the reciprocating motion of the piston 23, as a consequence of the engagement of the balls 38 in its thread.

The screw member 40 has a head portion 44 extending in a service chamber 50 of a casing 46 fixed to the head 27*b*. The service chamber 50 is connected with the source of fluid under pressure which selectively feed the feeding lines 28*a*, 29*a* or 28*b*, 29*b* through an opening 52 formed in the casing 46, upstream the aforesaid switching device, in such a manner that fluid under pressure is admitted in the chamber 50 when the fluid is fed to one of the feeding lines.

The head portion 44 is mounted in the chamber 50 in order to be rotatable and not axially slidable with respect to the casing 46 and to the cylinder 5, by means of rolling bearings. In the chamber 50, at its side opposite to the head 27*b* with respect to the head portion 44, an auxiliary floating piston 48, usually cup-shaped, is axially slidable and sealingly mounted so as not to rotate with respect to the casing 46, the auxiliary floating piston 48 being urged towards the head portion 44 by elastic biasing means. These elastic means can conveniently be constituted by a gas spring 56, preferably of the nitrogen type, having a push rod 58 resting on a surface of the piston 48 opposite to the head portion 44.

The facing surfaces of the head portion 44 and of the piston 48 are provided with corresponding mutually engaging formations, each of which is preferably formed by a crown gear 54 with radial front teeth 55 having a triangular shape, for example with their sides inclined of 60°, the toothings of the head portion 44 and of the piston 48 being equal to each other.

In the operation of the equipment 1, the fluid under pressure coming from the source is selectively fed to the feeding lines 28*a*, 29*a* and 28*b*, 29*b* so as to cause the reciprocating motion of the piston 23 within the chamber 25. As a result of the reciprocating motion of the piston 23 and through the toggle joint 9, the rod 10 controls the oscillation of the lever arm 7 and therefore of the apparatuses fixed to its attachment plate 20*a*.

The same source of the fluid under pressure is connected with the opening 52 of the casing 46, upstream the switching device allowing to feed selectively the feeding lines, in such a way that in the same manner fluid under pressure is admitted inside the chamber 50. The normal pressure of the fluid admitted in the chamber 50 is sufficient to oppose the elastic biasing action exerted by the elastic means 56 on the auxiliary piston 48, in order to hold the piston 48 spaced from the head portion 44 of the screw member 40, for example at a distance of a few millimeters. In such a condition, by virtue of the engagement of the thread of the shank 42 with the nut screw 34, the screw member 40 freely rotates about the axis of the rod 10 within the cavity 32 as a result of the motion of the piston 23.

In the case in which, for example owing to an accidental cause, the feeding of fluid under pressure from the source lacks, the delivery of fluid under pressure to the feeding lines 28*a*, 29*a* and 28*b*, 29*b* is stopped. In the same manner, the feeding of fluid under pressure to the chamber 50 is stopped whereby the auxiliary piston 48, under the biasing action of the elastic means 56, abuts against the head portion 44. The same happens in the case in which a pressure drop under a predetermined threshold occurs. As a result of the frontal engagement of the head portion 44 with the piston 48, the teeth of their crown gears 54 mutually mesh so that the rotation of the screw member 40 is locked, since the piston 48 cannot rotate with respect to the casing 46. As a consequence, the axial motion of the rod 10 is stopped and the sudden locking of the oscillation of the lever arm 7 takes place.

The control device of the present embodiment allows to lock in an extremely quick and effective manner the motion of the arm 7 in the case of lack or sudden drop of the pressure in the chamber 50 for any mounting position of the equipment 1. It is moreover able to stop the movement of rod 10 in both its movement directions.

In order to obviate the problem of the violent falling down of the arm 7, which may take place as a result of the wrong connection of the feeding and exhaust lines of the fluid under pressure, that is when an end of the cylinder 5 is connected with the feeding source of fluid under pressure while the opposite end communicates with the outside environment, decelerating units of a type known per se are conveniently used. Such decelerating units, usually of the oil transfer type, are associated to the arm 7 at its abutment surfaces 8*a* or 8*b* depending on which one of these surfaces is intended to be arranged in abutment or close to a respective side projection 6, namely on the basis of the selected angular mounting of the arm 7 with respect to the pins 17. Each decelerating unit has a slidable stem 14 (FIG. 1) intended to abut on a respective side projection 6, in order to dampen the impact of the branches 20 against the projections 6, so as to slow down the arm 7 at its end-of-travel.

Figure 7:
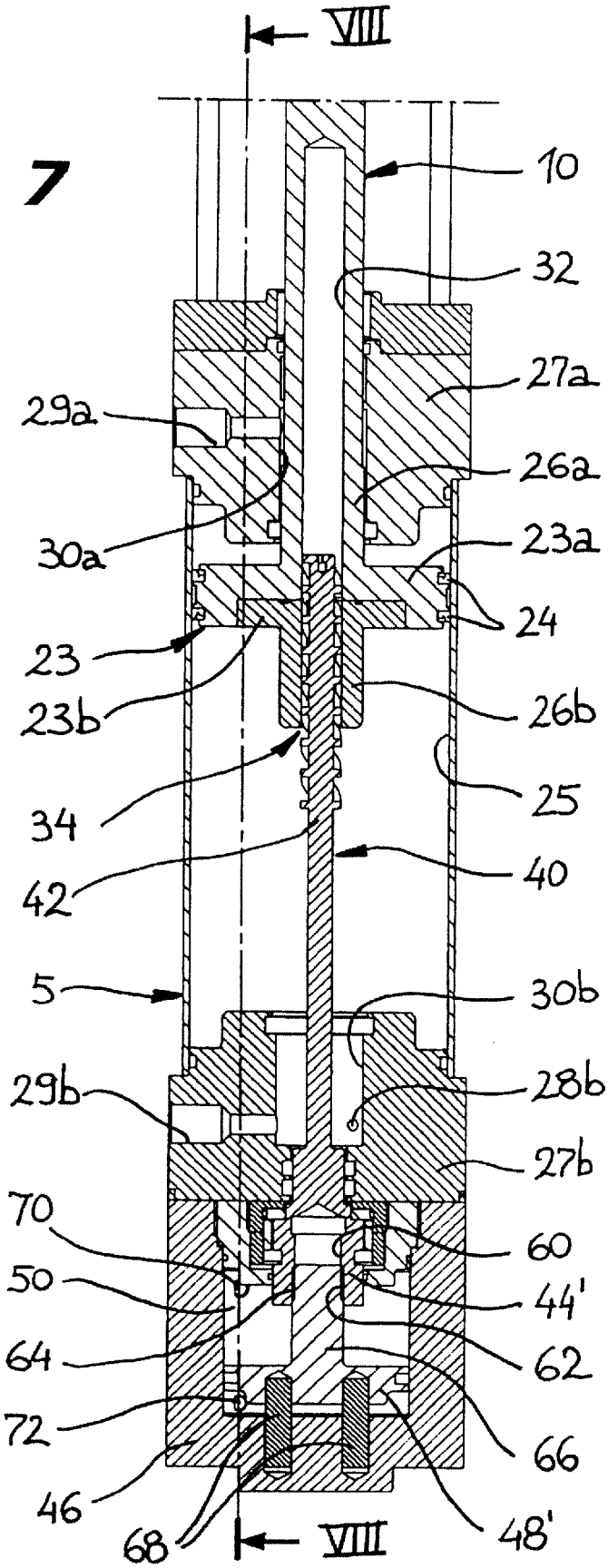
FIG. 7 is a side elevational view similar to FIG. 3, showing another embodiment of a swingable lever handling equipment provided with a control device according to the invention.

In FIGS. 7 to 9, in which the same reference numerals have been used for indicating elements equal or similar to those of the previous embodiment, the general structure of the cylinder 5 as well as of its piston 23 and the screw member 40, is the same of the previous embodiment. The head portion of the screw member, in this case indicated by the reference numeral 44', is different from that of the previous embodiment in that it has an axial dead hole 60 opening towards the chamber 50, in which an internal thread 62 is formed, for example with three start screw threads. The thread 62 is engaged by a corresponding external thread 64 formed at the end of a stem 66 axially extending from an auxiliary piston 48' sealingly mounted in the chamber 50, from its side facing the head portion 44'. The piston 48' can slide axially in the chamber 50 but it cannot rotate with respect to the casing 46. For this purpose, means for locking the rotation of piston 48' are associated to the portion of the piston 48' opposite to the stem 66 and to the bottom of the casing 46, the locking means being for example constituted by a pair of axial pins 68 which are slidably mounted in holes made in the bottom of the casing 46 and which are fixed to the piston 48', these pins being parallel and spaced with respect to the axis of the screw member 40.

A pair of transfer lines 70, 72, respectively arranged in proximity of the head 27*b* and in proximity of the bottom of the casing 46, open in the chamber 50 and are connected to each other by a line 74 formed in the wall of the casing 46. A viscous fluid, typically oil, is admitted in the chamber 50, and is transferred through the lines 70, 72 and 74 from one side to the other of the piston 48' as a result of its movement inside the chamber 50.

A screw 75 with a conical end is preferably associated to the line 72. The head of the screw 75 faces the outside of the casing 46 so that it can be driven by a driving tool such as a screwdriver in order to allow that the section of passage of the viscous fluid through the line 72 be modified for regulating the flow rate of such a fluid.

The member 40 rotates as a result of the motion of the piston 23 in the chamber 25 of the cylinder 5. The rotation of its head portion 44' causes the axial motion of the auxiliary piston 48', through the threads 62 and 64, as a function of the movement of the main piston 23, through a reduction ratio correlated to the pitch of the thread of the shank 42 and to the pitch of the threads 62 and 64. The axial motion of the piston 48' in the chamber 50 causes the movement of the viscous fluid through the lines 70, 72 and 74, causing a damping of the speed of movement of the auxiliary piston 48', and therefore of the main piston 23, which is a function of the flow rate of the fluid through the line 72. As a consequence, by varying the position of the screw 75 in the line 72 it is possible to adjust the maximum sliding speed of the piston 23. In particular, this allows to adjust such a speed with the aim of preventing the violent falling down of the arm 7 of the equipment 1 when conditions of anomalous connection of the cylinder 5 occurs, that is when one of its feeding lines is connected with the source of fluid under pressure while the other is open to the outside environment.

In order to overcome the drawback of the falling down of the arm 7 towards its lower position in the case of drop or lack of pressure in the chamber 25, for example as a result of a malfunction of the source of the pressure of the fluid fed to the cylinder 5, a valve device adapted to intercept the flow of the viscous fluid crossing the lines 70, 72 and 74 can be associated to the casing 46 when this anomalous operation condition occurs.

According to the embodiment illustrated in FIGS. 8 and 9, a bell shaped body 76 having a narrow cylindrical collar facing the chamber 50 is associated to the casing 46 at the transfer line 70. A cylindrical work chamber 78 communicating through a hole 80 and a respective line (not illustrated) with the source of the fluid under pressure selectively feeding the feeding lines of the cylinder 5, upstream the switching device, is defined inside the body 76. In this manner, fluid under pressure is admitted into the chamber 78, if fluid under pressure is fed into the chamber 25 of the cylinder 5 from one of the two sides of the piston 23. A preferably metallic needle obturator 82 is inserted in the body 76, and is adapted to cooperate with a seat 71 formed in the transfer line 70. The obturator 82 is provided with an enlarged head sealingly mounted in the chamber 78 and urged towards the chamber 50 by a spring 84, interposed between the head and a cover 86. The rod 82*a* of the obturator 82 is slidably and sealingly mounted in the cylindrical collar of the casing 46 and has an annular projection in order that its sliding travel caused by the biasing action of the spring 84 be limited.

When the fluid fed to the cylinder 5 is under pressure, it is fed also to the chamber 78 and allows to hold the needle obturator 82, against the action of the spring 84, in the condition illustrated in FIG. 8 in which the rod 82*a* is spaced from the seat 71, whereby the viscous fluid can freely flow through the lines 70, 72 and 74 allowing the free movement of the auxiliary piston 48'. In the case of drop or lack of pressure of the fluid fed to the cylinder 5, the same pressure drop occurs in the chamber 78, so that the rod 82*a* is urged, by the action of the spring 84, against the seat 71 in order to intercept the flow of the viscous fluid through the line 70. In this manner, the sliding of the auxiliary piston 48' in the chamber 50 is prevented and, with it, the rotation of the screw member 40 and the movement of the piston 23 are prevented, as well as the oscillation movement of the arm 7.

Figure 11:
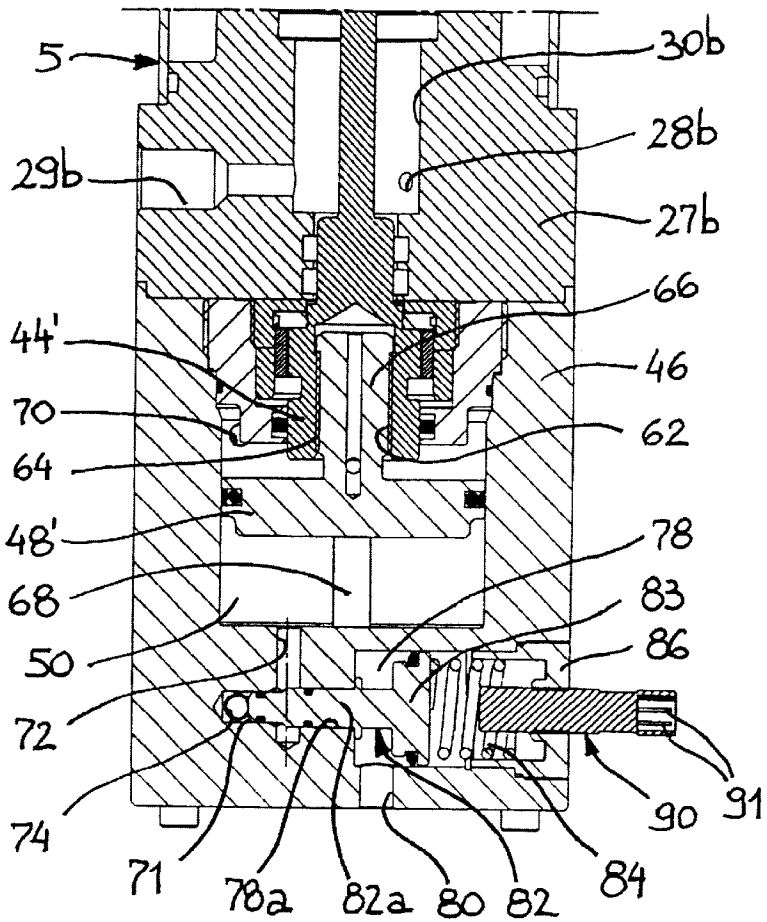
Figure 10:
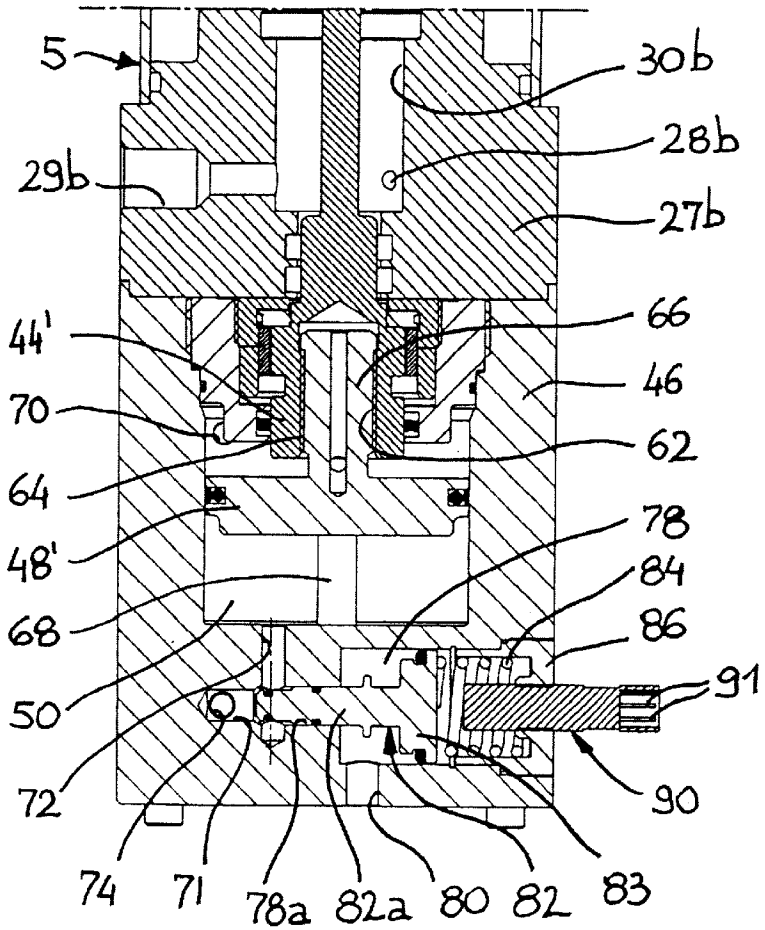

In the modification illustrated in FIGS. 10 and 11, in which the same reference numbers have been used for indicating elements equal or similar to those of the previous modification, the valve device which intercepts the viscous fluid passing through the lines 70, 72 and 74 is formed integrally with the casing 46. In particular, the cylindrical chamber 18 and the line 80 are formed in the casing 46, preferably in its bottom wall opposite to the cylinder 5 with respect to the chamber 50. The rod 82*a* of the needle obturator 82 slidably engages a hole 78*a* coaxial with the chamber 78 and with the line 71, which is connected by the line 74 to the line 70. The line 72 transversely extends between the hole 78*a* and the line 71 and opens at the bottom of the chamber 50, at the zone opposite to the head 44'. Sealing members, for example constituted by elastomeric rings, are associated to the rod 82*a* in order to seal the fluid between the rod 82*a* and the walls of the line 71 and of the hole 78*a*. Another sealing ring is arranged between the head of the obturator 82*a* and the wall of the cavity 78 in order to prevent the fluid to be discharged towards the cover 86.

The cover 86 can be provided with a position sensor 90, for example of the inductive type and connected by pins 91 to an electric network, in order to sense the condition in which the obturator 82 reaches the position in which the viscous fluid flow is stopped. In this condition, the sensor 90 is able to emit directly a signal, for example of the optical type through a LED, or to send an impulse through the pins 91 towards a signalling circuit (not illustrated) which includes an emitter for an optical or acoustic alarm signal.

Also in this modification a screw (not visible in FIGS. 10 and 11) is preferably arranged in order to allow the adjustment of the cross sectional area of the passage of the viscous fluid through the lines to transfer such a fluid from the opposite sides of the piston 48'. This screw, which is quite analogous to the screw 75 of the previous modification and can be driven from the outside of the casing 46 by means of a driving tool, is in this case conveniently associated to the line 70.

What is claimed is:

1. A device for controlling the oscillation of the arm of a handling equipment of the swingable lever type, in which the equipment comprises a driving double acting cylinder having a chamber in which a main piston is sealingly mounted, which is slidable as a result of the selective delivery of fluid under pressure at opposite zones of the chamber of the cylinder, the main piston being connected to a rod having a driving end which projects from the cylinder and is connected to said arm by a toggle joint, wherein said device comprises:

an axial cavity formed in the rod, in which a nut screw is arranged, a screw member comprising a threaded shank so arranged as to engage the nut screw of the rod, and a head portion opposite to the rod and mounted rotatably but not axially slidable with respect to the cylinder, and control means for controlling the rotating movement of the screw member, which are associated to the head portion of the screw member and are adapted to perform a braking action of its rotation when an anomalous condition occurs in the feeding of the fluid under pressure to the chamber of the cylinder.

2. A device according to claim 1, wherein said control means are adapted to keep the rotation speed of the head portion of the screw member below a predetermined threshold speed, in order to oppose the sliding of rod of the main piston in the cylinder with a speed higher than a prefixed threshold speed.

3. A device according to claim 2, wherein said control means comprise a casing fixed to an end of the cylinder and in which the head portion of the screw member is arranged, a service chamber in which a viscous fluid is admitted, typically oil, being defined in the casing, and in which an auxiliary piston is sealingly mounted and axially slidable, locking means intended to prevent the rotation of the auxiliary piston with respect to the casing being associated to the auxiliary piston, the auxiliary piston being connected to the head portion of the screw member by a screw-nut screw connection, whereby to a rotation of the screw member there corresponds an axial movement of the auxiliary piston being connected to each other by at least a passage line for the viscous fluid.

4. A device according to claim 3, wherein the auxiliary piston has an axial projection facing the screw member, which is provided with a threaded end engaging a nut screw formed in the head portion of the screw member.

5. A device according to claim 3, wherein the auxiliary piston is associated to the bottom of the casing, at a zone opposite to said cylinder, by a pair of axial slidable pins parallel to the axis of the screw member and spaced from it.

6. A device according to claim 3, wherein means for adjusting the cross sectional area of the line are interposed in the passage line for the viscous fluid, said means being adapted to be driven from the outside of the casing.

7. A device according to claim 6, wherein said means for adjusting the cross sectional area of the line comprise a conical end screw having a head which can be reached from the outside of the casing.

8. A device according to claim 3, wherein a valve device for intercepting the viscous fluid flow is associated to the passage line, such a device being able to be activated as a result of the lack or of the reduction below a prefixed threshold of the delivery of the fluid under pressure to the chamber of the cylinder, and being adapted to lock the sliding of the auxiliary piston within the service chamber and therefore the rotation of the head portion of the screw member, so as to lock the sliding of the rod of the piston.

9. A device according to claim 8, wherein said valve device comprises a needle obturator adapted to cooperate with a seat formed in said passage line with the aim of intercepting the viscous fluid flow, the obturator being provided with an enlarged head slidably and sealingly mounted within a work chamber of the valve device and being urged by biasing elastic means towards the position in which the needle obturator engages the respective seat, the work chamber being fed with fluid at the same pressure of the fluid feeding the chamber of the cylinder, whereby when the fluid under pressure is admitted in the work chamber the obturator is spaced from the respective seat against the action of the biasing elastic means so that the viscous fluid can flow through the passage line, while when the fluid pressure in the work chamber falls down below a predetermined threshold, the obturator is urged by the biasing elastic means towards an engagement position of the respective seat in which it intercepts the viscous fluid flow in the passage line.

10. A device according to claim 9, wherein the work chamber is formed in a wall of the casing, in order that the interception valve device is integral with the casing.

11. A device according to claim 9, wherein a position sensor is associated to the obturator for sensing its locking position of the viscous fluid flow through said passage line and for emitting a signal when such a position has been attained.

12. A device according to claim 11, wherein the obturator is metallic and the sensor is of the inductive type and is connected to an external cover on which the elastic biasing means rest.

13. A device according to claim 1, wherein said control means are adapted to carry out a locking action of the rotation of the head of the screw member and can be activated as a consequence of the lack of delivery of fluid under pressure to the chamber of the cylinder, whereby the locking of the head portion of the screw member by said control means causes the sliding of the rod of the main piston to be stopped.

14. A device according to claim 13, wherein the control means for controlling the rotation of the head portion comprise a casing fixed to an end of the cylinder and in which the head portion of the screw member is arranged, an auxiliary piston being also sealingly mounted and axially slidable but not rotatable in the service chamber and being urged by elastic biasing means towards the head portion of the screw member, the opposite surfaces of the head portion of the screw member and of the floating element being provided with corresponding mutually engaging formations and a fluid being fed to the chamber of the cylinder, whose pressure is equal to that of the fluid feeding the chamber of the cylinder, in order to hold the opposite surfaces of the head portion of the screw member and of the auxiliary piston spaced from each other against the action of the elastic biasing means, whereby when fluid under pressure is admitted into the service chamber the auxiliary piston is spaced from the head of the screw member against the action of the elastic biasing means in such a manner that the screw member can freely rotate, while when the pressure of the fluid in the service chamber falls down below a predetermined threshold the auxiliary piston is urged by the elastic biasing means towards the head portion of the screw member so as to cause the mutual engagement of the engaging formations and consequently locking the rotation of the head portion of the screw member.

15. A device according to claim 14, wherein the biasing elastic means comprise a gas spring, preferably of the nitrogen type.

16. A device according to claim 13, wherein the engaging formations of the head portion of the screw member and of the floating element include respective corresponding crown gears provided with radial front teeth.

17. A device according to claim 1, wherein the thread of the threaded shank is a multi-start screw thread having a pitch relatively large and in that said nut screw is made by a row of balls arranged within a series of axial grooves formed in the surface delimiting the axial cavity f the rod.

18. A device according to claim 17, wherein the thread of the threaded shank is a four-start thread.

19. A device according to claim 1, wherein the piston is formed by two parts, the nut screw being made in one of said parts in such way that said grooves open axially at the surface of separation of said two parts of the piston.

* * * * *